US007314329B1

(12) United States Patent
Byun

(10) Patent No.: US 7,314,329 B1
(45) Date of Patent: Jan. 1, 2008

(54) COSMETICS CASE

(76) Inventor: Young-Kwang Byun, 928-1005, Mok-dong APT, 312, Shinjeong-dong, Yangcheon-ku, Seoul 158-769 (KR)

( * ) Notice: Subject to any disclaimer, the term of this patent is extended or adjusted under 35 U.S.C. 154(b) by 0 days.

(21) Appl. No.: 11/528,441

(22) Filed: Sep. 28, 2006

(30) Foreign Application Priority Data

Jul. 20, 2006 (KR) ..... 10-2006-0067830

(51) Int. Cl.
*A46B 11/04* (2006.01)

(52) U.S. Cl. ..... 401/279; 401/270; 401/180

(58) Field of Classification Search ..... 401/270–273, 401/275, 278, 279, 286, 170, 176, 179
See application file for complete search history.

(56) References Cited

U.S. PATENT DOCUMENTS 6,224,287 B1 * 5/2001 Gieux ..... 401/282
6,363,948 B2 * 4/2002 Choi ..... 132/313

* cited by examiner

*Primary Examiner*—Huyen Le

(74) *Attorney, Agent, or Firm*—Birch, Stewart, Kolasch & Birch, LLP

(57) ABSTRACT

This invention is related to a structure of cosmetics liquid discharge guider of the cosmetics case 1. The cosmetics case is object of during pressing a conical elastic part 33 composed of intermediate member 28 and moving an opening valve 29 due to the air pressure generated while the inner moving body 10 ascends and descends so that the inner hole 30 is opened and cosmetics liquid is discharged to the brush 56 by passing vertical and horizontal discharge guider 29*a*, 29*b* and liquid transporting passage 36 formed in upper and lower part of an opening valve 29 through a discharger 54, that the inner moving body 10 descends due to the expansion force of a conical elastic part 33 and the elastic force of a spring 34 and returns, and that the inner hole 30 is closed by an inclined plane 29*c* formed in a upper part of an opening valve 29 to prevent cosmetics liquid from being discharged. The conical elastic part 33 and a spring 34 is compressed formed in an intermediate member 28 by pressing and releasing the inner moving body 10 so that it is possible to freely discharge and to freely prevent the cosmetics liquid. The inner moving body 10 can be separated and opened due to easily assembling and dismantling of the inner moving body 10 and the connecting member 24 when the cosmetics liquid provided with the inner moving body 10 is exhausted so that the inner moving body 10 is refilled.

3 Claims, 10 Drawing Sheets

COSMETICS CASE

CROSS-REFERENCE TO RELATED APPLICATIONS

This application claims the benefit of Korean Patent Application No. 10-2006-0067830, filed on Jul. 20, 2006, in the Korean Intellectual Property Office, the disclosure of which is incorporated herein by reference

BACKGROUND

1. Field of Invention

The present invention related to a structure of cosmetics liquid discharge guider of the cosmetics case. The cosmetics case is object of during pressing a conical elastic part 33 composed of intermediate member 28 and moving an opening valve 29 due to the air pressure generated while the inner moving body 10 ascends and descends so that the inner hole 30 is opened and cosmetics liquid is discharged to the brush by passing vertical and horizontal discharge guider 29*a*, 29*b* and liquid transporting passage 36 formed in upper and lower part of an opening valve 29 through a discharger 54, that the inner moving body 10 descends due to the expansion force of a conical elastic part 33 and the elastic force of a spring 34 and returns, and that the inner hole 30 is closed by an inclined plane 29*c* formed in a upper part of an opening valve 29 to prevent cosmetics liquid from being discharged. The conical elastic part 33 and a spring 34 is compressed formed in an intermediate member 28 by pressing and releasing the inner body 10 so that it is possible to freely discharge and to freely prevent the cosmetics liquid. The inner moving body can be separated and opened due to easily assembling and dismantling of the inner body and the connecting member when the cosmetics liquid provided with the inner moving body is exhausted so that the inner moving body is refilled.

2. Discussion of Related Art

Since the liquid cosmetics case is composed of simply fixed cosmetics brush formed in an opening of the upper part of the tube shaped-container. Although liquid cosmetics stored in the tube shaped-container is discharged to cosmetics brush by pressing and releasing the tube shaped-container to let a user apply make-up, the liquid cosmetics container is defective for carrying and keeping from leaking cosmetics liquid unnecessarily due to pressed the tube shaped-container carelessness.

Also, in order to solve the above-described problems, liquid stored container selected using container of hard material but is composed of inner and outer moving body so that a discharge guider is positioned in the upper part of the inner moving body. The structure of liquid cosmetics case in which the cosmetics liquid stored in the inner moving body is discharged to cosmetics brush by pressing of inner moving body is using due to possessing a cosmetics brush in an upper part of the outer moving body.

However, since the liquid cosmetics case is using with discharging liquid cosmetics liquid repeatedly so that pressed and constricted inner and outer moving body by pressing and releasing of outer moving body can not return. The liquid cosmetics container is defective by contaminated and damaged around from leaking the cosmetics liquid when it keeps without care.

SUMMARY OF THE INVENTION

In order to solve the above-described problem, during pressing a conical elastic part composed of intermediate member and moving an opening valve due to the air pressure generated while the inner moving body ascends and descends so that the inner hole is opened and cosmetics liquid is discharged to the brush by passing vertical and horizontal discharge guider and liquid transporting passage formed in upper and lower part of an opening valve through a discharger, that the inner moving body descends due to the expansion force of a conical elastic part and the elastic force of a spring and returns, and that the inner hole is closed by an inclined plane formed in a upper part of an opening valve to prevent cosmetics liquid from being discharged. The conical elastic part and a spring is compressed formed in an intermediate member by pressing and releasing the inner moving body so that it is possible to freely discharge and to freely prevent the cosmetics liquid. It is an object of the present invention to provide a structure of cosmetics liquid discharge guider of the cosmetics case. The inner moving body can be separated and opened due to easily assembling and dismantling of the inner moving body and the connecting member when the cosmetics liquid provided with the inner moving body is exhausted so that the inner moving body is refilled.

The cosmetics case that is present invention is object of during pressing a conical elastic part composed of a intermediate member and moving an opening valve due to the air pressure generated while the inner moving body ascends and descends so that the inner hole is opened and cosmetics liquid is discharged to the brush by passing vertical and horizontal discharge guider and liquid transporting passage formed in upper and lower part of an opening valve through a discharger, that the inner moving body descends due to the expansion force of a conical elastic part and the elastic force of a spring and returns, and that the inner hole is closed by an incline plane formed in a upper part of an opening valve to prevent cosmetics liquid from being discharged. The conical elastic part and a spring is compressed formed in an intermediate member by pressing and releasing the inner moving body so that it is possible to freely discharge and to freely prevent the cosmetics liquid. The inner moving body can be separated and opened due to easily assembling and dismantling of the inner moving body and the connecting member when the cosmetics liquid provided with the inner moving body is exhausted so that the inner moving body is refilled.

BRIEF DESCRIPTION OF THE VIEWS

These and/or other objects and advantages of the invention will become apparent and more readily appreciated from the following description of preferred embodiments, taken in conjunction with the accompanying views of which:

DETAILED DESCRIPTION OF PREFERRED EMBODIMENTS

Hereinafter, preferred embodiments of the present invention will be described with reference to the accompanying views.

Figure 1:
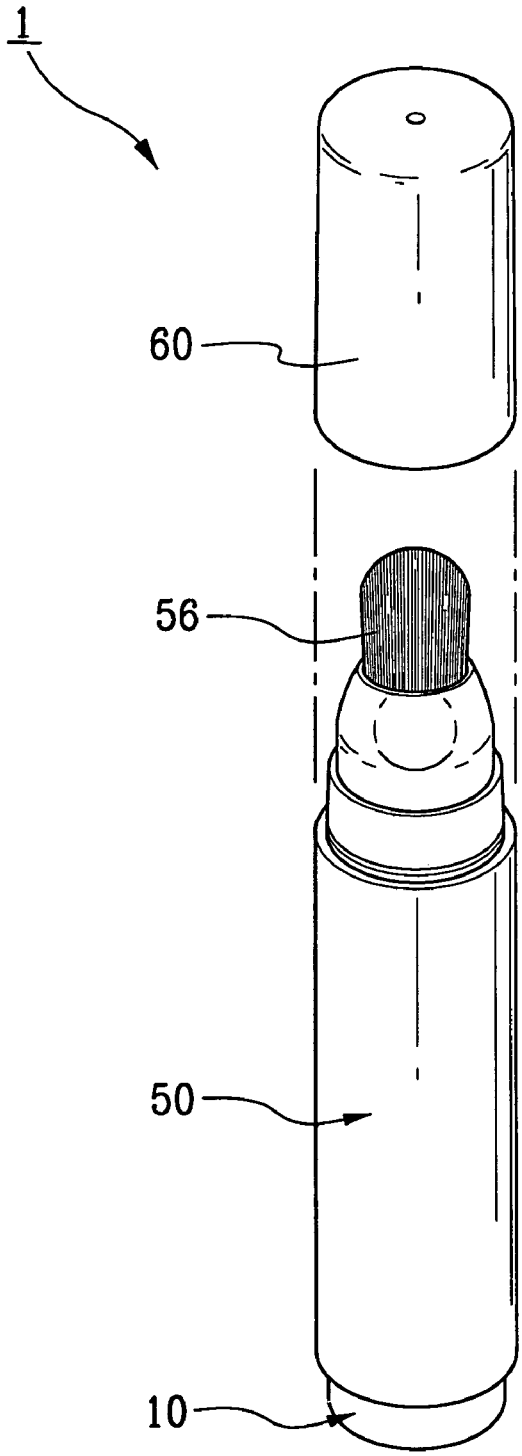
FIG. 1 is a perspective view of an opened tap cosmetics case of the first embodiment according to the present invention.
Figure 2:
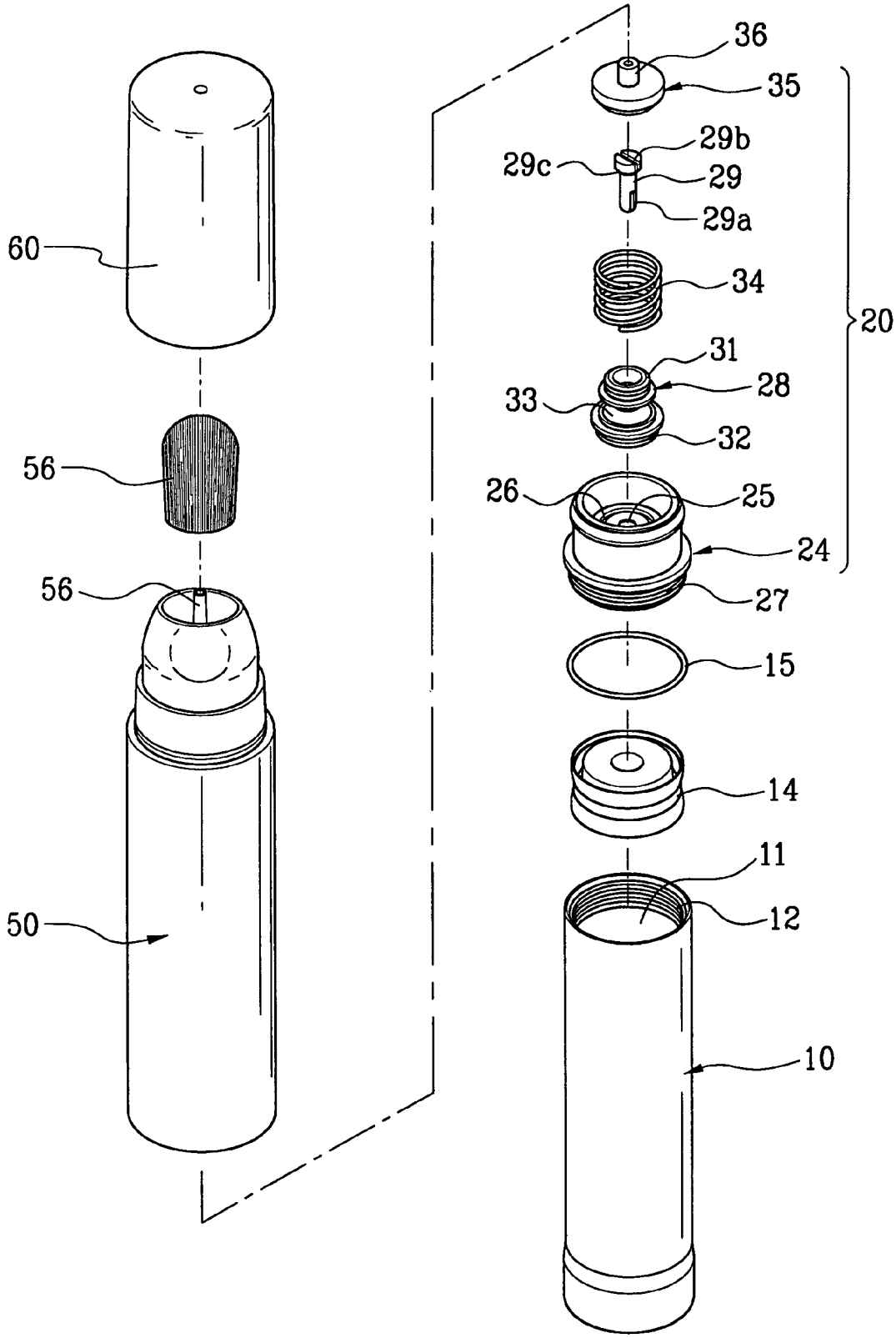
FIG. 2 is a exploded perspective view of the cosmetics case of the first embodiment according to the present invention.
Figure 3:
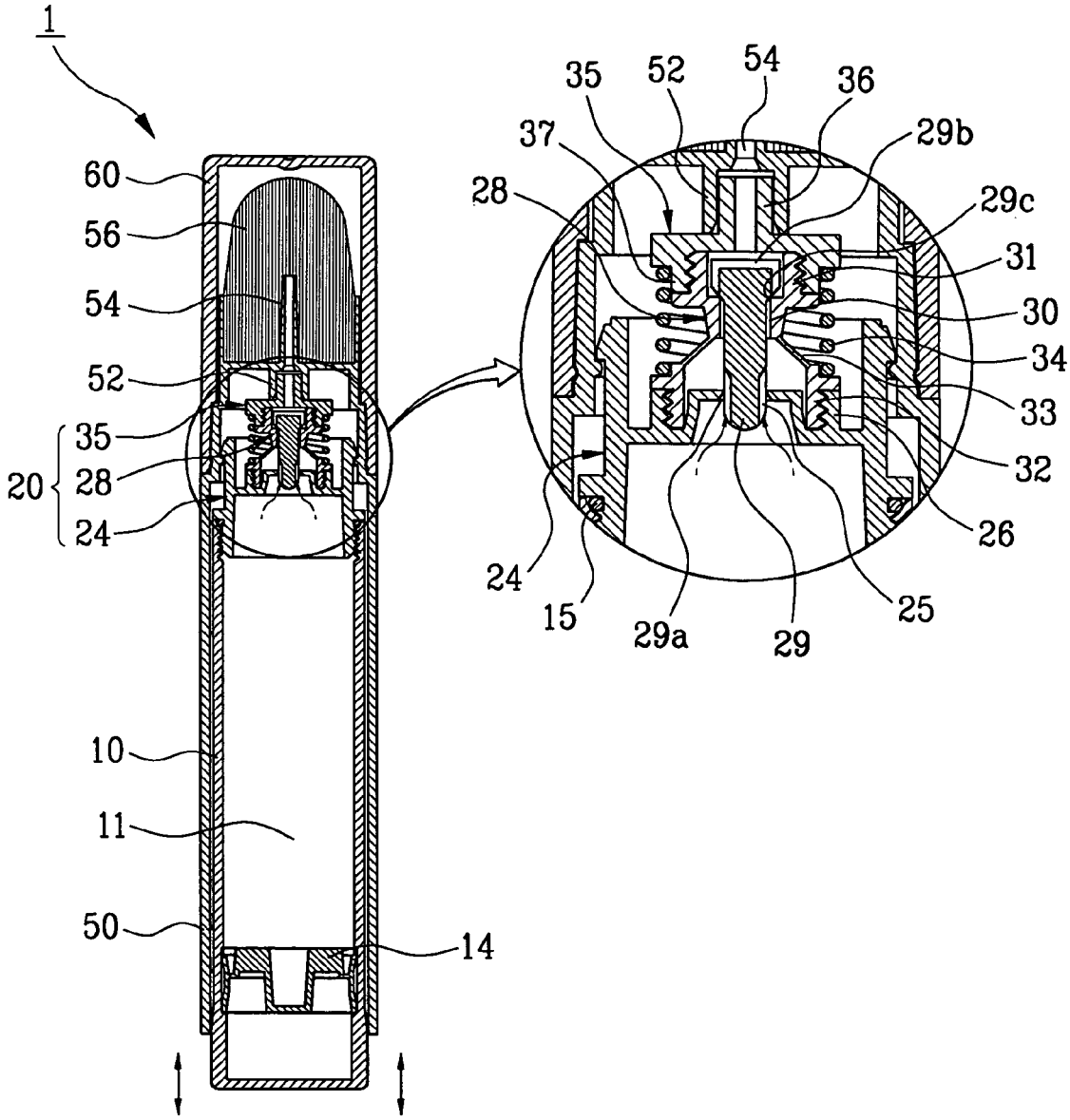
FIG. 3 is a sectional view of the cosmetics case of the first embodiment according to the present invention.
Figure 4:
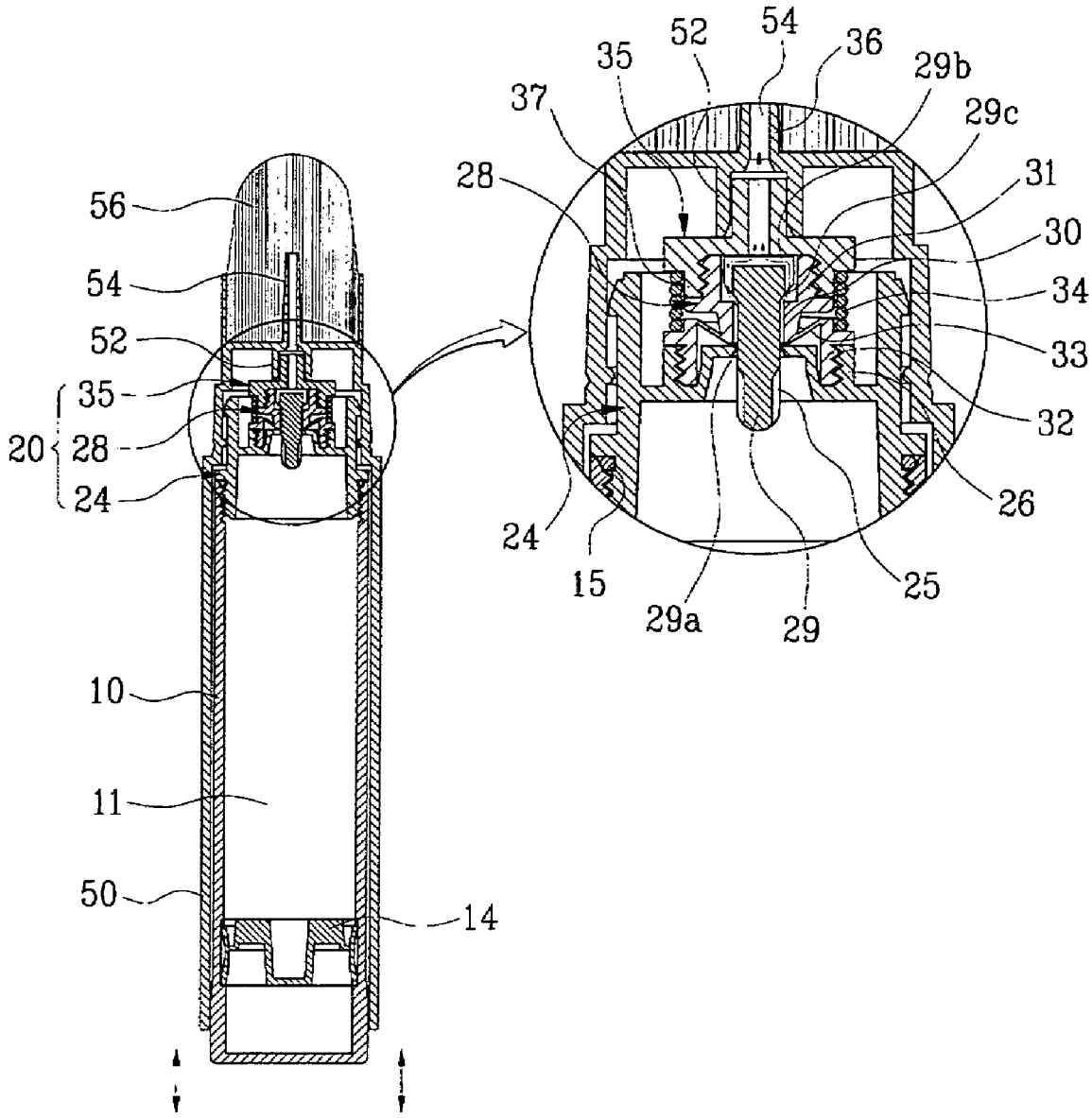
FIG. 4 is a cross sectional view of the cosmetics case of the first embodiment in which an inner moving body forces up according to the present invention.

FIG. 1 is a perspective view of an opened tap cosmetics case according to the present invention. FIG. 2 is an exploded perspective view of the cosmetics case according to the present invention. FIG. 3 is a sectional view of the cosmetics case according to the present invention. FIG. 4 is a cross sectional view of the cosmetics case in which an inner moving body forces up according to the present invention. The structure of cosmetics liquid discharge guider 20 of the cosmetics case 1 is composed of outer moving body 50 coupled by engaging is coupled by tap 60 of the inner moving body 10 in outer part so that composed the connecting member 24 is thread coupled with upper part of the inner moving body 10, the intermediate member 28 contained an opening valve 32 and a discharge guider 20 coupled with an engaging member 35, but the connecting member hole 25 is formed in the upper and center part of the connecting member 24 so that an intermediate member connecting part 26 is formed in a circumference part and formed on a thread connecting part 27 is coupled with in the inner and upper part of the inner moving body 10 in the lower part. The inner hole 30 is formed in an intermediate member 28 that provided with an opening valve 29 to the inner part so that the upper outer thread 31 is formed in the upper part and the lower outer thread 37 is formed in the lower part that is coupled with the intermediate member connecting part 26 is formed in the connecting member 24 so that the spring 34 is settled in the circumference and the liquid transporting passage 36 is formed in the inner part of an engaging member 35. The lower and inner thread 37 is formed in the lower part in which it is coupled with the upper and outer thread 31 that is formed in the intermediated member 28 of the upper part so that the liquid transporting passage 36 is inserted into the engaging part formed in the upper part of the outer moving body 50

The cosmetics case 1 that is present invention is object of during pressing a conical elastic part 33 composed of an intermediate member 28 and moving an opening valve 29 due to the air pressure generated while the inner moving body 10 ascends and descends so that the inner hole 30 is opened and cosmetics liquid is discharged to the brush 56 by passing vertical and horizontal discharge guider 29*a*, 29*b* and liquid transporting passage 36 formed in upper and lower part of an opening valve 29 through a discharger 54, that the inner moving body 10 descends due to the expansion force of a conical elastic part 33 and the elastic force of a spring 34 and returns, and that the inner hole 30 is closed by an inclined plane 29*c* formed in a upper part of an opening valve 29 to prevent cosmetics liquid from being discharged. The conical elastic part 33 and a spring 34 is compressed formed in an intermediate member 28 by pressing and releasing the inner moving body 10 so that it is possible to freely discharge and to freely prevent the cosmetics liquid.

Hereinafter, the present invention will be described in detail with reference to the attached views.

As illustrated in FIGS. 2 to 4, according to the present invention, an accommodation part 11 having a liquid in the inner part of the inner moving body 10 thereof is formed and an inner thread 12 is formed in the circumference of the upper and inner part.

The connecting member hole 25 in the upper and center part is formed in the inner thread 12 in the upper part so that an intermediate member connecting part 26 is formed in the circumference and the connecting member 24 formed in the thread connecting part 27 of the lower part is thread coupled by the thread connecting part 27.

The intermediate member connecting part 26 is formed in the upper part of the connecting member 24 that it formed in the inner hole 30 inserted into an opening valve 29 so that the upper and outer thread 31 is formed in the upper part, the lower and outer thread 32 is formed in the lower part and the intermediate member 28 inserted into the spring 34 in the circumference is thread coupled by the lower and outer thread 32.

As illustrated in FIG. 2, according to an opening valve 29, a horizontal discharge guider 29*b* and an inclined plane 29*c* are formed in the upper part and a vertical discharge guider 29*a* is formed in the lower part to help a cosmetics liquid transporting.

The upper and outer thread 31 is formed in the upper part of an intermediate member 28 and is composed of a discharge guider 20 due to an engaging member 35 formed in liquid transporting passage 36 and a lower and inner thread 37 that engaging member 35 is thread coupled by a lower and inner thread 37.

Therefore, a discharge guider 20 coupled with a connecting member 24, an intermediate member 28, and an engaging member 35 is coupled with the upper part of the inner moving body 10 so that an engaging part 52 and a discharger 54 provided with the upper part are coupled with the inner moving body 10 formed in a brush 56. The liquid transporting passage 36 is formed in an upper part of an engaging member 35 and is coupled by an engaging part 52 that is formed in the upper and inner part of the outer moving body 50 and a tap 60 is inserted into the upper part of the outer moving body 50 so that the cosmetics case 1 including a discharge guider 20 can be assemble.

The operation of the cosmetics case will be described as follows.

As illustrated in FIG. 3, at normal times, the cosmetics case 1 of the present invention does not force to the lower part of the inner moving body 10 and the inner moving body 10 faces downward from the inner part of the outer moving body 50 so that it is closed by tap 60 coupled with the upper part of the outer moving body 50.

Also, an inclined plane 29*c* is formed in the upper part of an opening valve 29 inserted into the inner part of an intermediate member 28 maintained closing condition touched with the upper circumference of the inner hole 30. The vertical discharge guider 29*a* is formed in the lower part passed through the connecting member hole 25 of the connecting member 24 so that the connecting member hole 25 is opened.

When a closed inner hole 30 pressed the lower part of the inner moving body 10 due to an inclined plane 29*c* of an opening valve 29 so that pressed a conical elastic part 33 is formed in an intermediate member 28 and the inner moving body 10 will be ascends to the inner part of the outer moving body 50. At this time, due to a compression holder 14 inserted into the inner part of the inner moving body 10, an accommodation part 11 of the inner moving body 10 inserted into the cosmetics liquid is compressed. Therefore, with ascending the inner moving body 10, an accommodation part 11 is compressed by a compression holder 14, as illustrated in FIG. 4, an inclined plane 29*c* of an opening valve 29 seceded from a closed inner hole 30 is opened the inner hole 30 and the spring 34 in the circumference of an intermediate member 28 stayed with compressed condition.

The liquid case of the prevent invention turns upside down with an opened opening valve 29 so that the cosmetics liquid in an accommodation part 11 of the inner moving body 10 is discharged to the brush 56 by passing vertical and horizontal discharge guider 29*a*, 29*b* and liquid transporting passage 36 formed in upper and lower part of an opening valve 29 through a discharger 54. Discharged cosmetics liquid to the brush 56 let a user apply make-up with proper amount on the brush 56.

Therefore, when the force of pressed the inner moving body 10 is released after the make-up, a conical elastic part 33 formed in an intermediate member 28 expands and descends the inner moving body 10 so that an inner hole 30 is closed by an inclined plane 29*c* of an opening valve 29 and prevents to discharge the cosmetics liquid of an accommodation part 11 through the inner hole 30 and prevents to leak the cosmetics liquid when it does not used.

Also, the spring 34 in the circumference of the intermediate member 28 helps the inner moving body 10 to descend with expanding a conical elastic part 33 due to the properties of firing so that it helps the inner moving body 10 easily returns.

On the other hand, the compression holder 14 in the accommodation part 11 of the inner moving body 10 is at a standstill without descent with the inner moving body 10 due to compressed condition of the accommodation part 11 even if the inner moving body 10 descends so that the compression holder 14 moves to the upper part of the inner moving body 10 by the repeatedly press of the inner moving body 10 and makes vacuum condition in the inner part of the accommodation part 11.

Therefore, the present invention, a conical elastic part 33 formed in an intermediate member 28 is expanding and compressing by pressing and releasing of the inner moving body 10 and the inner hole 30 is opened by the opening valve 29 in the inner part of the intermediate member 28. When the inner moving body 10 is pressed to make-up, the inner hole 30 is opened to easily discharge of the cosmetics liquid. When the inner moving body 10 is released, the inner hole 30 is closed.

The inner moving body 10 and the connecting member 24 are thread coupled with together so that the inner moving body 10 can be separated and opened due to easily assembling and dismantling of the inner moving body 10 and the connecting member 24 when the cosmetics liquid in the inner moving body 10 is exhausted so that the inner moving body 10 is refilled.

According to the view of the present invention, the part of brush 56 faces upward has been described. However, when the brush 56 is used in practice, the brush 56 faces downward.

Figure 5:
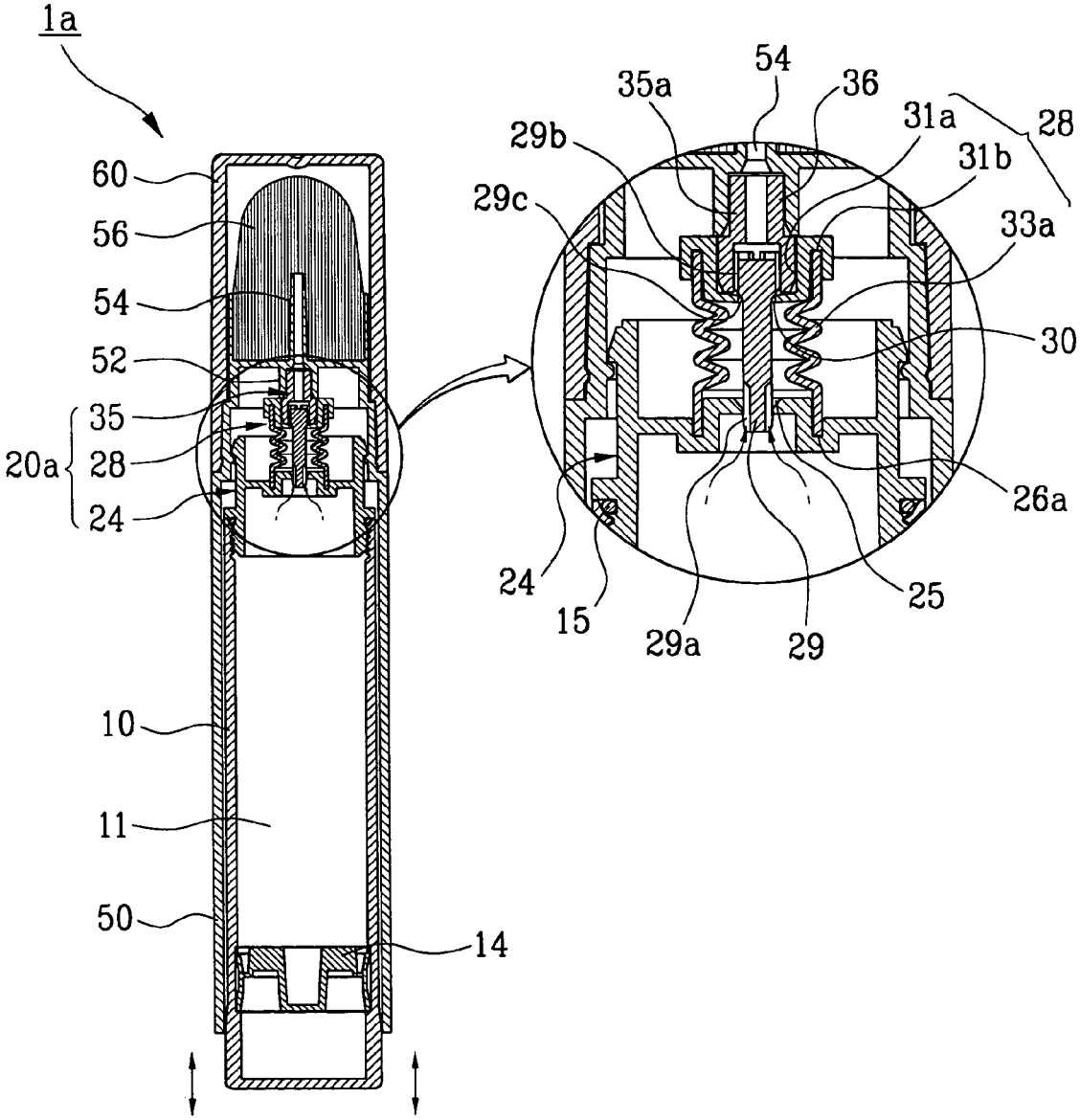
FIG. 5 is a cross sectional view of the cosmetics case of the second embodiment according to the present invention.
Figure 6:
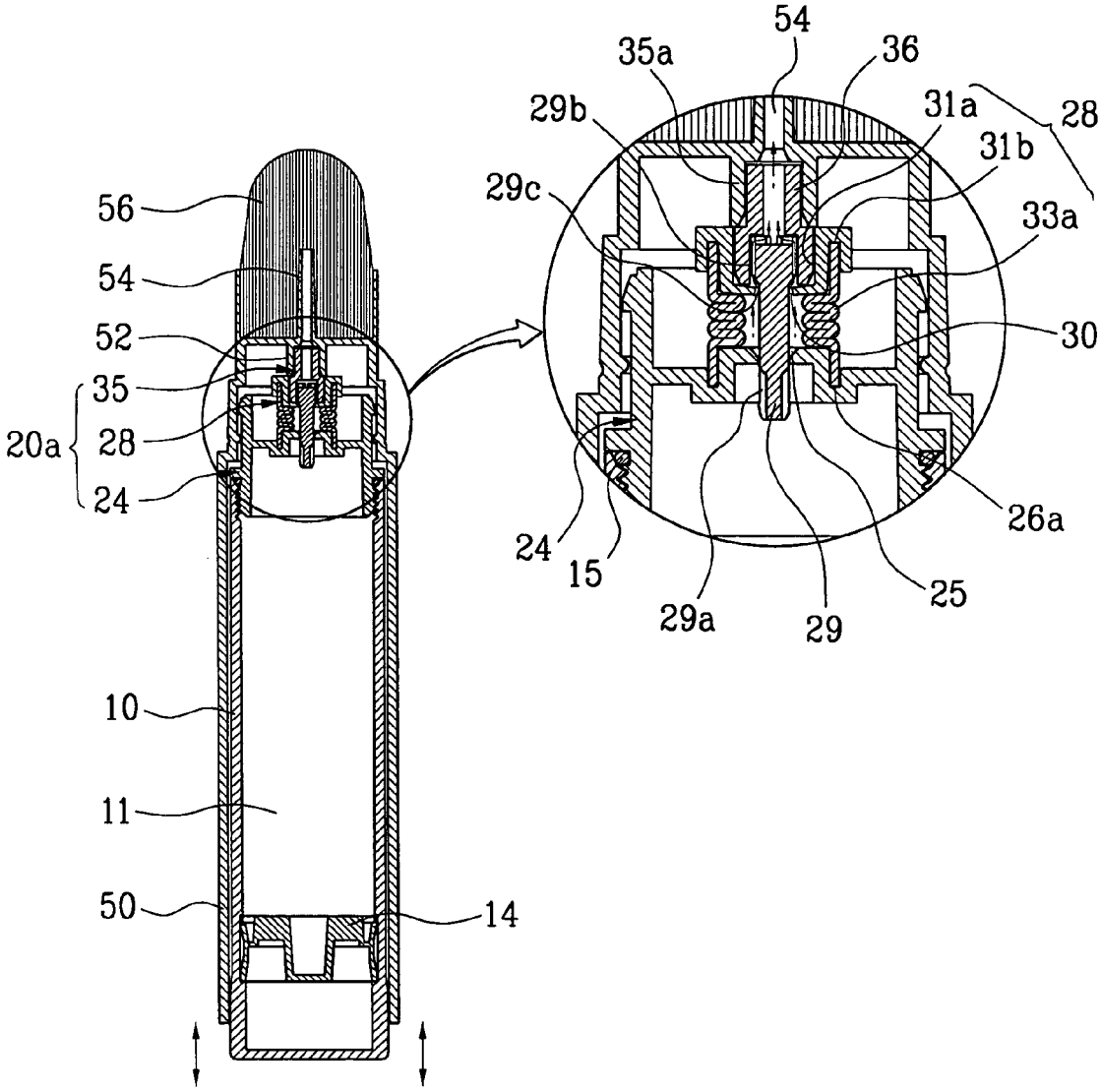
FIG. 6 is a cross sectional view of the cosmetics case of the second embodiment in which an inner moving body forces up according to the present invention.

FIG. 5 is a cross sectional view of the cosmetics case 1 of the second embodiment according to the present invention. FIG. 6 is a cross sectional view of the cosmetics case of the second embodiment in which an inner moving body 10 forces up according to the present invention. A cosmetic solution case having the discharge structure, which is the connecting member 24 is thread coupled in the upper part of inner moving body 10 and the discharge guider 20 is coupled with an engaging member 35 and an intermediate member 28 including an opening valve 29, a connecting member hole 25 is formed in the upper and center part and an tube connecting part 26*a* is formed in the circumference, a thread connecting part 27 coupled with inner and upper part of inner moving body 10 is formed in lower part of the connecting member 24 and is formed in the upper part of the connecting member 24, the inner hole 30 is formed in the inner part inserted into an opening valve 29 and the inner engaging part 31*a* is formed in the upper part, the outer engaging part 31*b* is formed in the circumference and the upper part of rumples shaped tube 33*a* is fixed, the lower part of the rumples shaped tube 33*a* and an intermediate member 28 coupled with tube connecting part 26*a* formed in a connecting member 24 are engaged and settled the inner engaging part 31*a* of the intermediate member 28. The discharge guider 20 coupled with an engaging member 35 is engaged the liquid transporting passage 36 due to the engaging part 52 formed in the upper and inner part of the outer moving body 50.

Also, the cosmetics case 1 of the first embodiment, during pressing a rumples shaped tube 33*a* composed of intermediate member 28 and moving an opening valve 29 due to the air pressure generated while the inner moving body 10 ascends and descends so that the inner hole 30 is opened and cosmetics liquid is discharged to the brush 56 by passing vertical and horizontal discharge guider 29*a*, 29*b* and liquid transporting passage 36 formed in upper and lower part of an opening valve 29 through a discharger 54, that the inner moving body 10 descends due to the expansion force of a conical elastic part 33 and the elastic force of a spring 34 and returns, and that the inner hole 30 is closed by an inclined plane 29*c* formed in a upper part of an opening valve 29 to prevent cosmetics liquid from being discharged. The rumples shaped tube 33*a* is compressed formed in an intermediate member 28 by pressing and releasing the inner moving body 10 so that it is possible to freely discharge and to freely prevent the cosmetics liquid.

Figure 7:
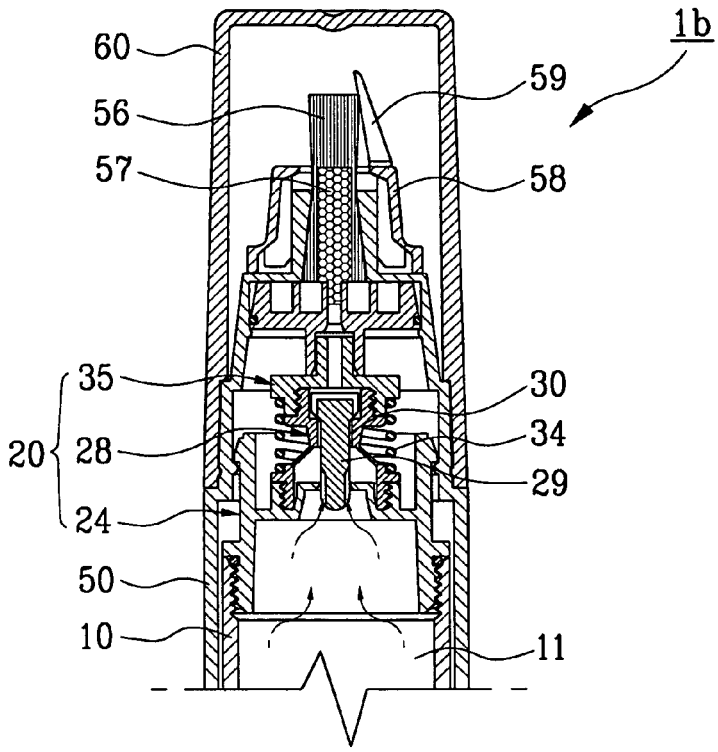
FIG. 7 is a sectional view of the cosmetics case of the third embodiment according to the present invention.
Figure 8:
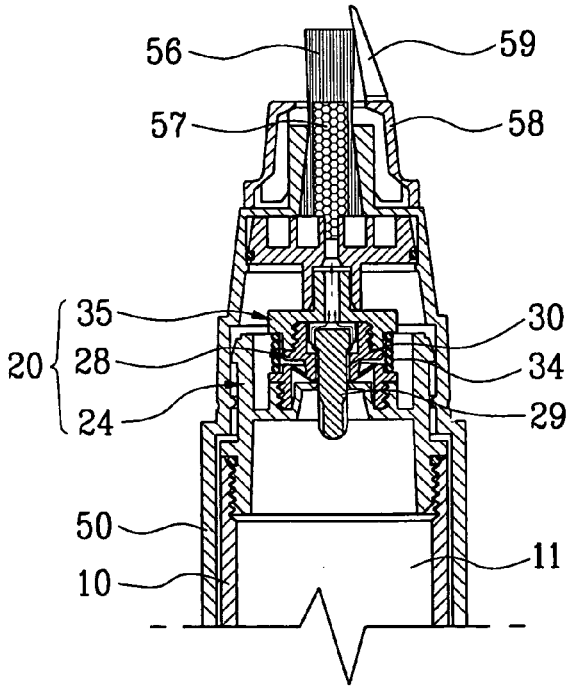
FIG. 8 is a sectional view of the cosmetics case of the third embodiment in which an inner moving body forces up according to the present invention.

FIG. 7 is the principal part magnifying cross sectional view of the cosmetics case 1 of the second embodiment according to the present invention. FIG. 8 is the principal part magnifying cross sectional view of the cosmetics case 1 of the second embodiment in which an inner moving body 10 forces up according to the present invention. A cosmetic solution case having the discharge structure, which is the connecting member 24 is thread coupled in the upper part of inner moving body 10 and the discharge guider 20 is coupled with an engaging member 35 and an intermediate member 28 including an opening valve 29, the outer moving body 50 including a moist body 57 and a brush 56 is coupled in the upper part coupled with the inner moving body 10 and the discharge guider 20 so that the brush moving part 58 including a brush edge 59 is formed in the upper part of the outer moving body 50.

The cosmetic liquid in an accommodation part of an inner moving body 10, for example, a hair-dye is discharged to the brush 56 through the inner hole 30 due to turning upside down a liquid case 1. The cosmetics liquid discharged to the moist body 57 lets a user apply make-up like hair dyeing with using the brush edge 59 formed in the brush moving body 58 and the brush 56 with proper amount on the brush 56.

Figure 9:
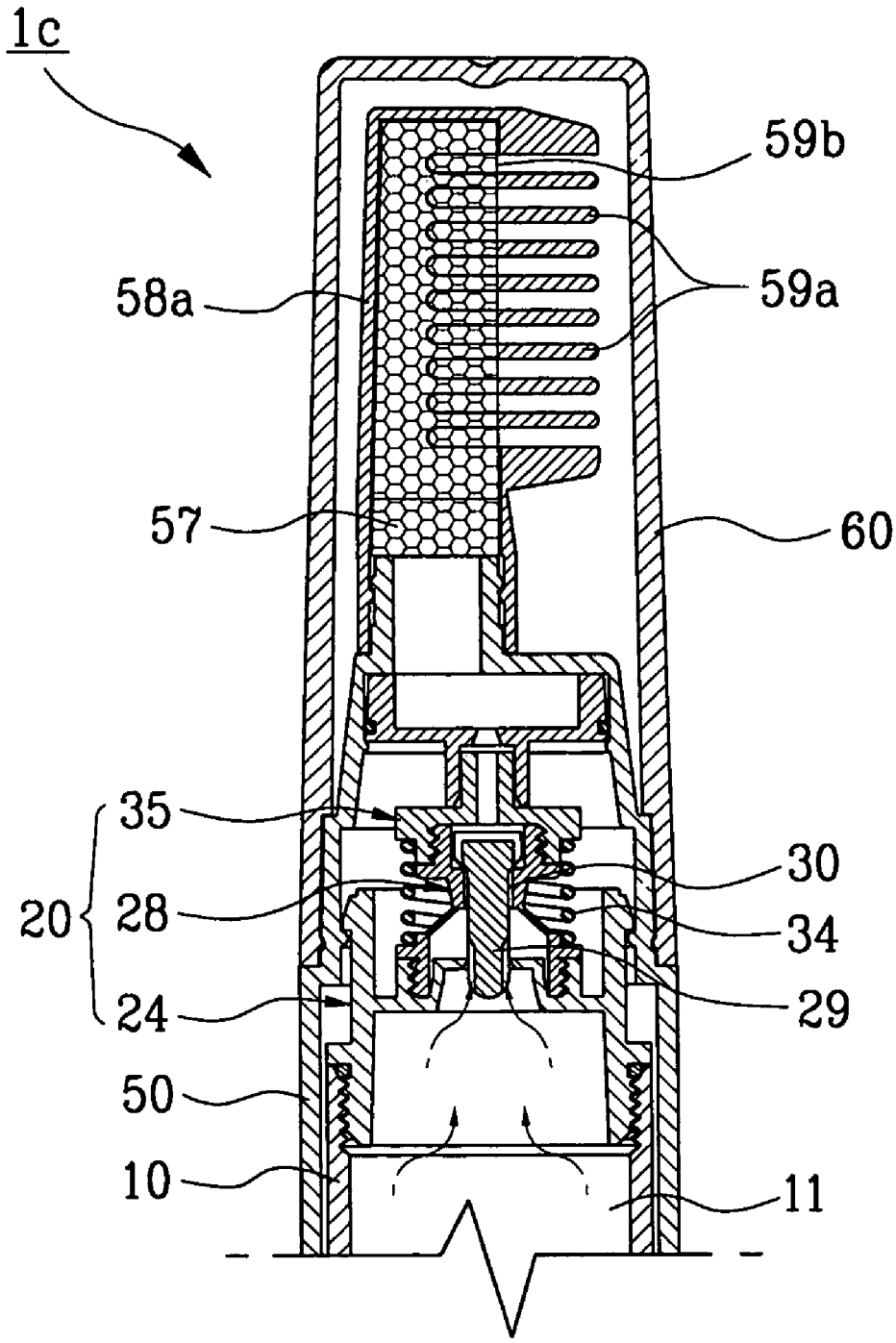
FIG. 9 is a sectional view of the cosmetics case of the fourth embodiment according to the present invention.
Figure 10:
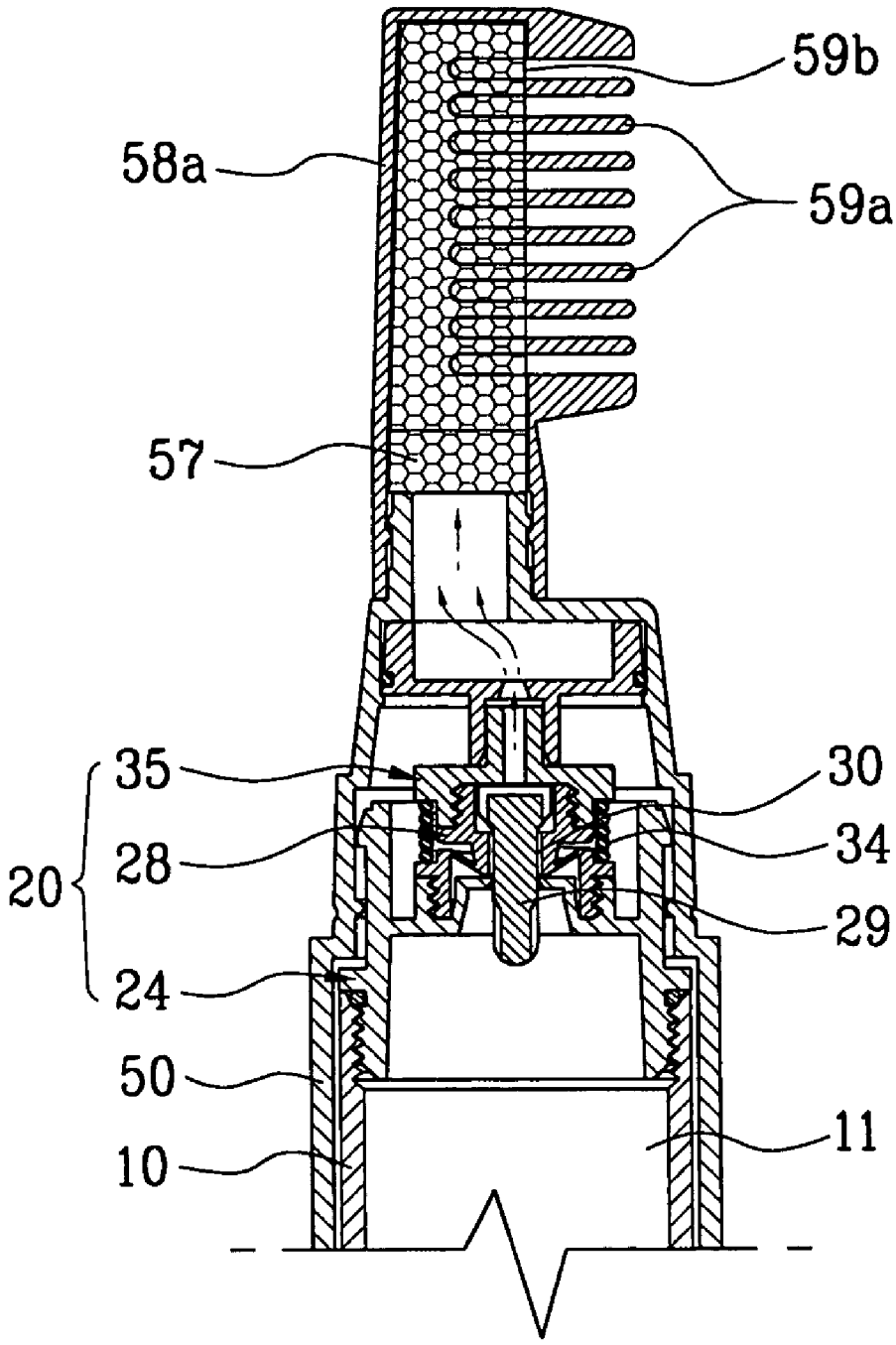
FIG. 10 is a sectional view of the cosmetics case of the fourth embodiment in which an inner moving body forces up according to the present invention.

FIG. 9 is the principal part magnifying cross sectional view of the cosmetics case of the third embodiment according to the present invention. FIG. 10 is the principal part magnifying cross sectional view of the cosmetics case of the third embodiment in which an inner moving body 10 forces up according to the present invention. A cosmetic solution case having the discharge structure, which is the connecting member 24 is thread coupled in the upper part of inner moving body 10 and the discharge guider 20 is coupled with an engaging member 35 and an intermediate member 28 including an opening valve 29, although the outer moving body 50 is coupled in the upper part of the inner moving body 10, the moist body 57 is inserted into the upper part of the outer moving body 50 and the cylindrical brush 58*a* moving edge including the vertical brush edge 59*a* is coupled in the upper part of the outer moving body 50.

The cosmetic liquid in an accommodation part of an inner moving body 10, for example, a hair-dye is discharged to the moist body 57 through the inner hole 30 due to turning upside down a liquid case 1. The cosmetics liquid discharged to the moist body 57 is properly discharged through the discharge hole 59*b* and lets a user apply make-up like hair dyeing with using the horizontal brush edge 59*a*.

Figure 11:
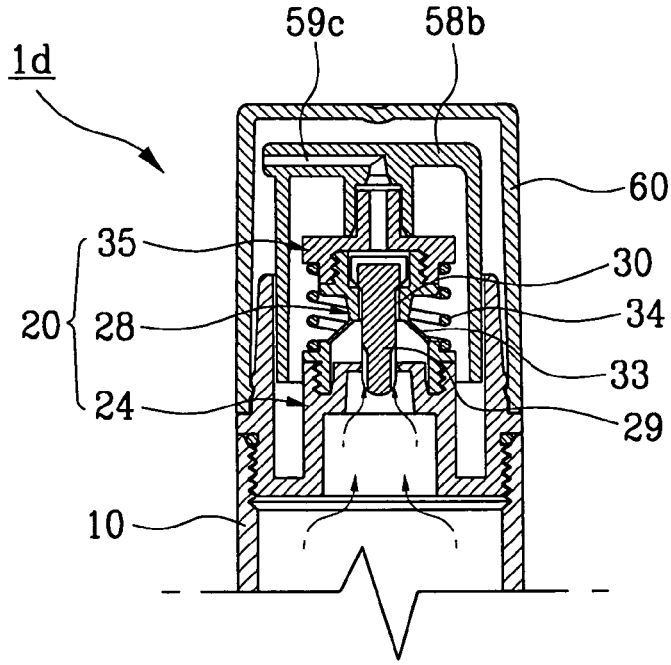
FIG. 11 is a sectional view of the cosmetics case of the fifth embodiment according to the present invention.
Figure 12:
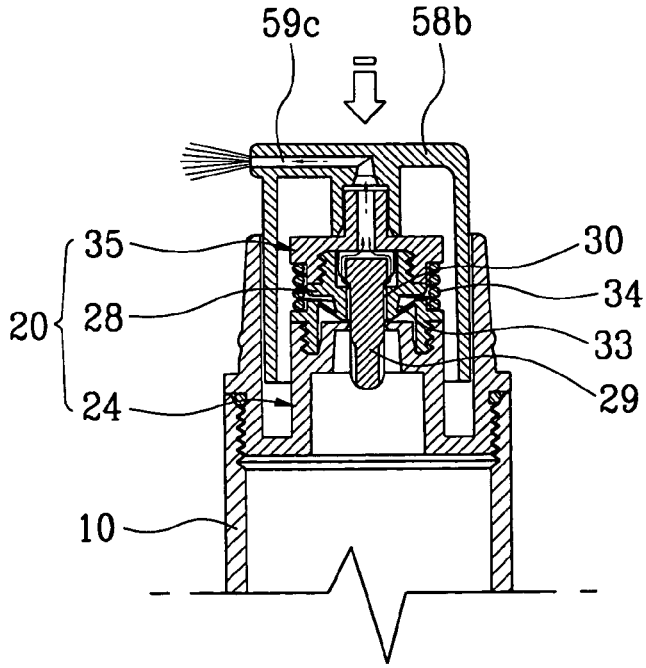
FIG. 12 is a sectional view of the cosmetics case of the fifth embodiment in which an inner moving body forces up according to the present invention.

FIG. 11 is the principal part magnifying cross sectional view of the cosmetics case 1 of the fifth embodiment according to the present invention. FIG. 12 is the principal part magnifying cross sectional view of the cosmetics case 1 of the fifth embodiment in which an inner moving body 10 forces up according to the present invention. A cosmetic solution case having the discharge structure, which is the connecting member 24 is thread coupled in the upper part of inner moving body 10 and the discharge guider 20 is coupled with an engaging member 35 and an intermediate member 28 including an opening valve 29, the spray moving body 58*b* including the horizontal spray hole 59*c* is coupled in the upper part of the engaging member 35 formed in the discharge guider 20. The liquid case 1 spouts out the cosmetics liquid through the horizontal spray hole 59*c* by applying the air pressure to the inner part of the inner moving body 10 due to ascends and descends of the spray moving body 58*b* and the inner hole 30 is opened by compressing the conical elastic part 33 including the intermediate member 28 and the opening valve 29 is moved.

The outer of inner moving body 10 is coupled with an outer moving body 50.

What is claimed is:

1. A discharge guide for a cosmetics case, the case including an outside body which is insert coupled to an inside body, the discharge guide comprising:

a coupler which is threadingly coupled on an upper portion of said inside body;

a middle member including an open and close valve;

an inserting member, said coupler, middle member and inserting member being jointed;

a coupler hole formed on a center of an upper portion of the coupler;

a middle member coupling part being formed on a periphery of the coupler hole;

a threaded coupling member formed on a lower portion of the coupler which is threadingly coupled on an insider upper portion of the inside body;

an inside hole formed in said middle member for receiving said open and close valve;

an upper portion outer threaded member formed on an upper portion of said middle member;

a bottom outer threaded member formed on a lower portion of said middle member is coupled to the middle member coupling part;

a spring mounted on a periphery of the bottom outer threaded member;

a solution transfer formed on an inside of the inserting member;

a lower inside threaded part formed on a lower part of the inserting member which is coupled with the upper portion outer threaded member;

insert part formed on an insider upper portion of the outer body; and the solution transfer being insertingly coupled with the insert part, whereby cosmetic product provided in said inside body is discharged through a guide including the coupler hole, the open and close valve, the solution transfer and the insert part.

2. The discharge guide according to claim 1, further comprising a cap which is coupled to the outside body.

3. The discharge guide according to claim 1, further comprising a brush mounted in an upper portion of the outer body for receiving cosmetic product discharged from the insert part.

* * * * *